US008138452B2

(12) United States Patent
Thomas et al.

(10) Patent No.: US 8,138,452 B2
(45) Date of Patent: Mar. 20, 2012

(54) CONVECTION OVEN

(75) Inventors: David Stewart Thomas, Stevensville, MI (US); Stephan A. Lemons, Michigan City, IN (US); Abu Noman Hossain, Fort Wayne, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 697 days.

(21) Appl. No.: 12/172,301

(22) Filed: Jul. 14, 2008

(65) Prior Publication Data

US 2010/0006085 A1 Jan. 14, 2010

(51) Int. Cl.
*A21B 1/00* (2006.01)
*F28F 1/20* (2006.01)

(52) U.S. Cl. ..... 219/400; 219/412; 219/507; 219/702; 219/715; 219/720; 126/21 A; 165/104.34; 165/181

(58) Field of Classification Search ..... 219/412, 219/400, 507, 702, 715, 720; 126/21 A; 165/104.34, 181
See application file for complete search history.

(56) References Cited

U.S. PATENT DOCUMENTS

| | | | | |
|---|---|---|---|---|
| 3,797,473 | A | 3/1974 | Mutchler | |
| 3,802,832 | A | 4/1974 | Nicolaus | |
| 3,828,760 | A | 8/1974 | Farber et al. | |
| 3,991,737 | A | 11/1976 | Del Fabbro | |
| 4,029,463 | A | 6/1977 | Johansson et al. | |
| 4,071,739 | A | 1/1978 | Jenn et al. | |
| 4,308,853 | A | 1/1982 | Thirode | |
| 4,373,504 | A | 2/1983 | Day | |
| 4,467,777 | A | 8/1984 | Weber | |
| 4,484,561 | A | 11/1984 | Baggott et al. | |
| 4,503,760 | A | 3/1985 | Pryputsch et al. | |
| 4,561,348 | A | 12/1985 | Halters et al. | |
| 4,951,645 | A | 8/1990 | Luebke et al. | |
| 4,968,515 | A | 11/1990 | Burkett et al. | |
| 4,986,253 | A | 1/1991 | Bienert et al. | |
| 5,460,158 | A | 10/1995 | Rigaud | |
| 5,485,780 | A | 1/1996 | Koether et al. | |
| 5,598,769 | A | 2/1997 | Luebke et al. | |
| 6,545,251 | B2 | 4/2003 | Allera et al. | |
| 6,805,112 | B2 | 10/2004 | Cole et al. | |
| 6,854,457 | B2 | 2/2005 | Rabas et al. | |
| 6,874,495 | B2 | 4/2005 | McFadden | |
| 6,933,472 | B1 | 8/2005 | Smith et al. | |
| 6,943,321 | B2 * | 9/2005 | Carbone et al. | 219/400 |
| 2004/0118392 | A1 | 6/2004 | McFadden | |
| 2004/0211765 | A1 | 10/2004 | McFadden | |
| 2004/0216732 | A1 | 11/2004 | McFadden | |
| 2005/0092314 | A1 | 5/2005 | Rabas et al. | |
| 2005/0217503 | A1 | 10/2005 | McFadden | |
| 2005/0224064 | A1 | 10/2005 | Stockley | |

FOREIGN PATENT DOCUMENTS

| | | | |
|---|---|---|---|
| EP | 0611524 | A1 | 8/1994 |
| JP | 09-126463 | A | 5/1997 |

* cited by examiner

*Primary Examiner* — Shawntina Fuqua
(74) *Attorney, Agent, or Firm* — McGarry Bair, PC

(57) ABSTRACT

A convection system for an oven comprising a baffle defining a single heating chamber mounted within a cavity of the oven, a heating element located within the single heating chamber for heating air within the heating chamber, and at least two fans located within the heating chamber. The oven cavity can be defined, in part, by a wall having at least a portion with a curved peripheral edge, so that air exhausted through the outlet is deflected away from the wall.

24 Claims, 11 Drawing Sheets

CONVECTION OVEN

BACKGROUND OF THE INVENTION

1. Field of the Invention

This invention generally relates to convection ovens, and more particularly to air circulation in the oven cavity.

2. Description of the Related Art

Ovens utilizing convection heating are well-known. Convection ovens heat objects, such as food items, within an oven cavity by transferring heat from a heating element to the food item by the circulation of a convecting gas within the oven cavity. A common problem in convection ovens is non-uniform air flow in the oven cavity. This can lead to temperature differences between areas within the oven cavity, which makes it difficult to achieve uniform heating of the food item in the oven cavity. This problem is exacerbated by placing food items on racks at different heights within the oven cavity.

In an attempt to address this problem, many convection ovens employ fans to generate air circulation to improve air flow uniformity. Some known convection oven heating systems use a single fan located centrally on a wall of the oven cavity. Other known ovens utilize a convection heating system having multiple fans. However, neither of these solutions optimize convection heating since airflow can still be uneven with these systems. Therefore, it remains that a convection system is needed that will create a more uniform temperature throughout the oven cavity.

SUMMARY OF THE INVENTION

A convection oven according to one aspect of the present invention, the invention relates to a housing defining an oven cavity and a convection system fluidly coupled to the oven cavity. The convection system comprises a baffle mounted to the housing and defining a single heating chamber, and having an inlet and an outlet fluidly coupling the single heating chamber with the oven cavity, a heating element located within the single heating chamber for heating air within the heating chamber, and at least two fans located within the heating chamber for drawing air from the oven cavity into the heating chamber through the inlet, and exhausting air heated by the heating element from the heating chamber to the oven cavity through the outlet.

According to another aspect of the invention, the invention relates to a convection oven comprising a housing having a rear wall with a curved peripheral edge and a peripheral wall extending from the curved peripheral edge to define an oven cavity with an open face, a door moveably mounted to the housing for selectively closing the open face, and a convection system having an inlet and an outlet in fluid communication with the oven cavity, with the outlet facing at least a portion of the curved peripheral edge and adjacent the rear wall wherein air exiting the outlet is directed along the rear wall to the curved peripheral edge, which deflects the air toward the open face.

DESCRIPTION OF THE PREFERRED EMBODIMENT

Figure 1A:
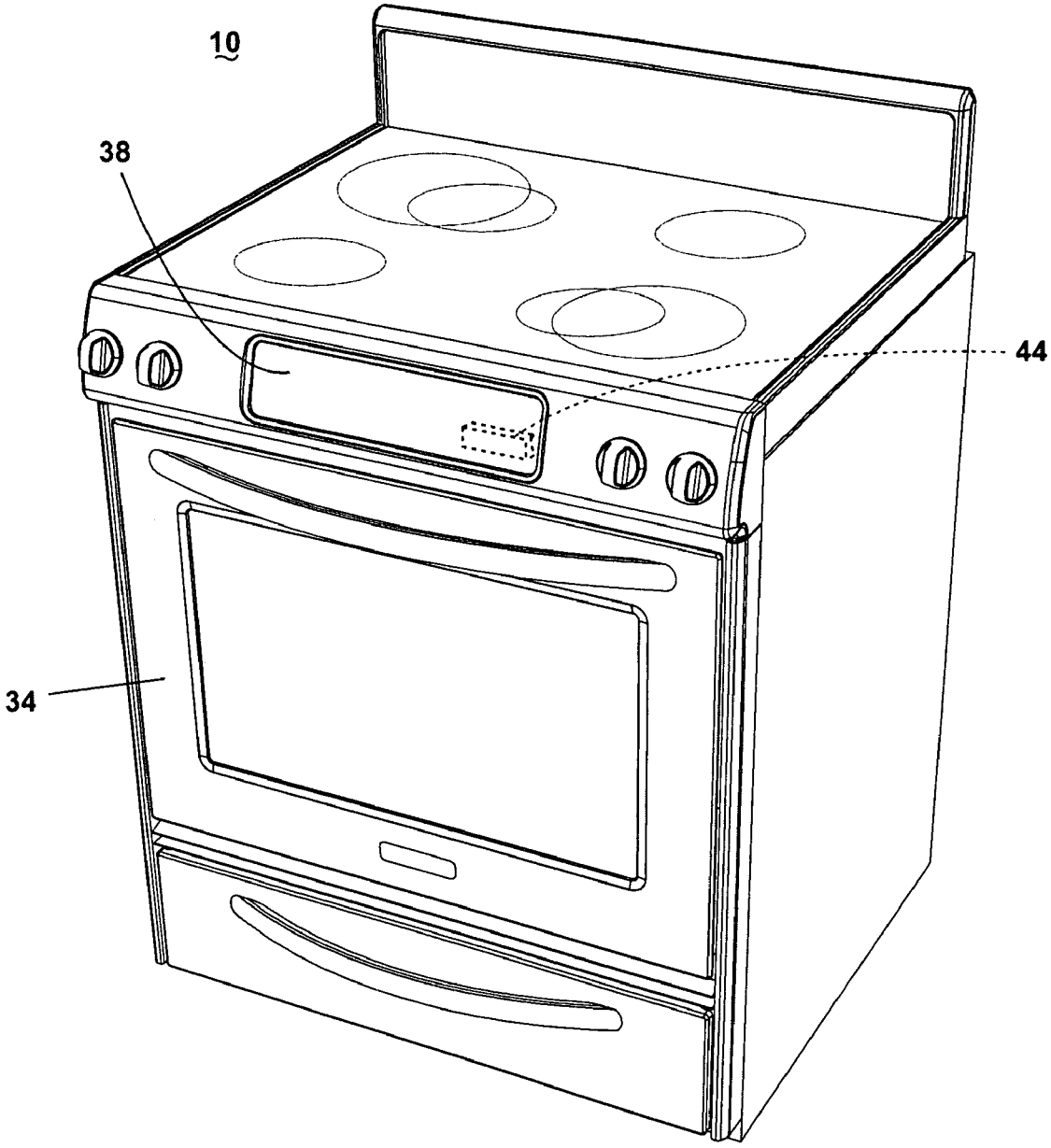
FIG. 1A is a perspective view of an exemplary oven comprising a convection system according to the present invention.
Figure 1B:
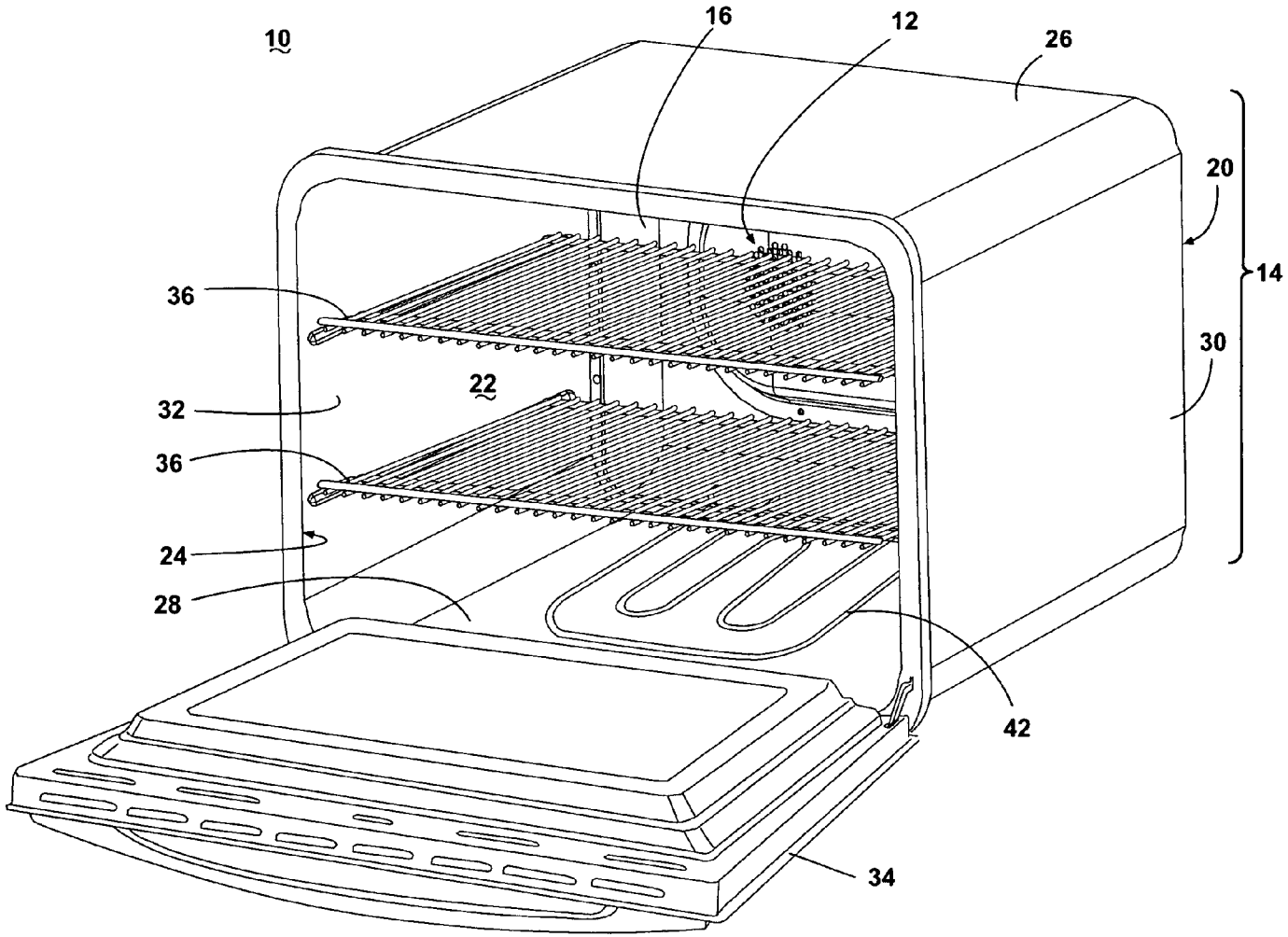
FIG. 1B is a perspective view of the exemplary oven from FIG. 1A with an oven door open to show the convection system according to the present invention.
Figure 2:
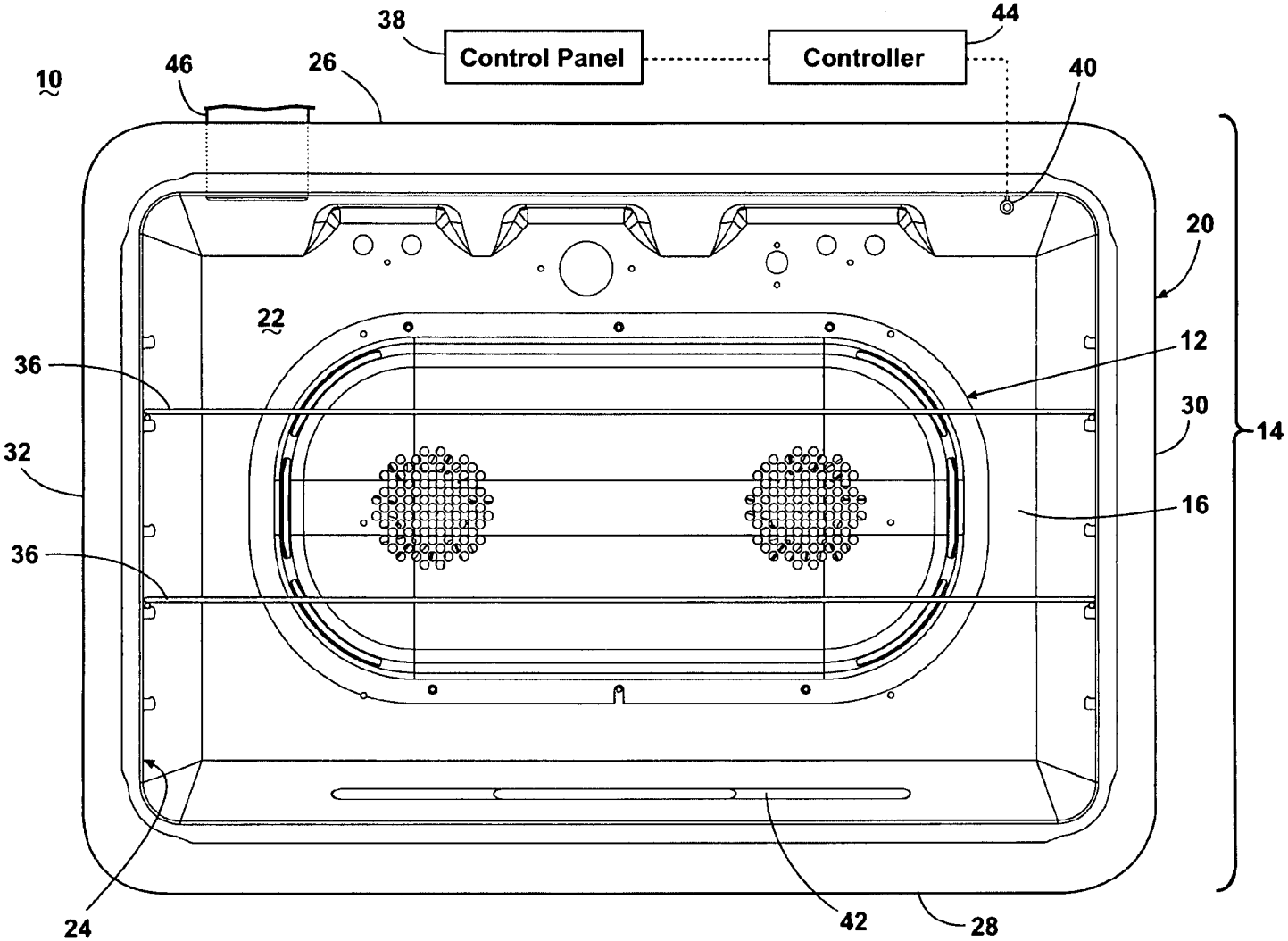
FIG. 2 is a schematic illustration of the exemplary oven from FIG. 1.

Referring to the drawings, and in particular to FIGS. 1A, 1B and 2, an example of an oven 10 with the convection system 12 according to the present invention is illustrated. For convenience, the term "air" is used herein to describe the convecting gas; however, it is understood that other convecting gases, such as nitrogen or steam, can be used as well. The oven 10 includes an oven housing 14 comprising a rear wall 16 that is joined with a peripheral wall 20 to define an oven cavity 22 with an open front face 24. The peripheral wall 20 includes upper and lower walls 26, 28 joined with right and left side walls 30, 32. The open front face 24 can be selectively closed by an oven door 34 moveably mounted to the oven housing 14.

One or more racks 36 can be placed within the oven cavity 22 for supporting food items to be heated or cooked. A control panel 38 is provided, through which a user can control the operation of the oven 10. A temperature sensor 40 is in communication with the oven cavity 22 for detecting the temperature of air within the oven cavity 22. One or more heating elements 42 commonly used as a heat source during a broiling or baking cooking operation are positioned on a wall of the oven housing, for instance, the lower wall 28. A controller 44 receives feedback from the temperature sensor 40 and the control panel 38 and accordingly controls the operation of the heating elements 42 and the convection system 12. An air vent 46 is positioned in a wall of the oven cavity 22 for fluidly communicating the oven cavity 22 with the external environment. Other features common to convection ovens that are not germane to the invention are not disclosed herein. The convection system 12 is mounted to a wall of the oven cavity 22, and is preferably installed on the rear wall 16 of the oven cavity 22, as illustrated herein.

Figure 3:
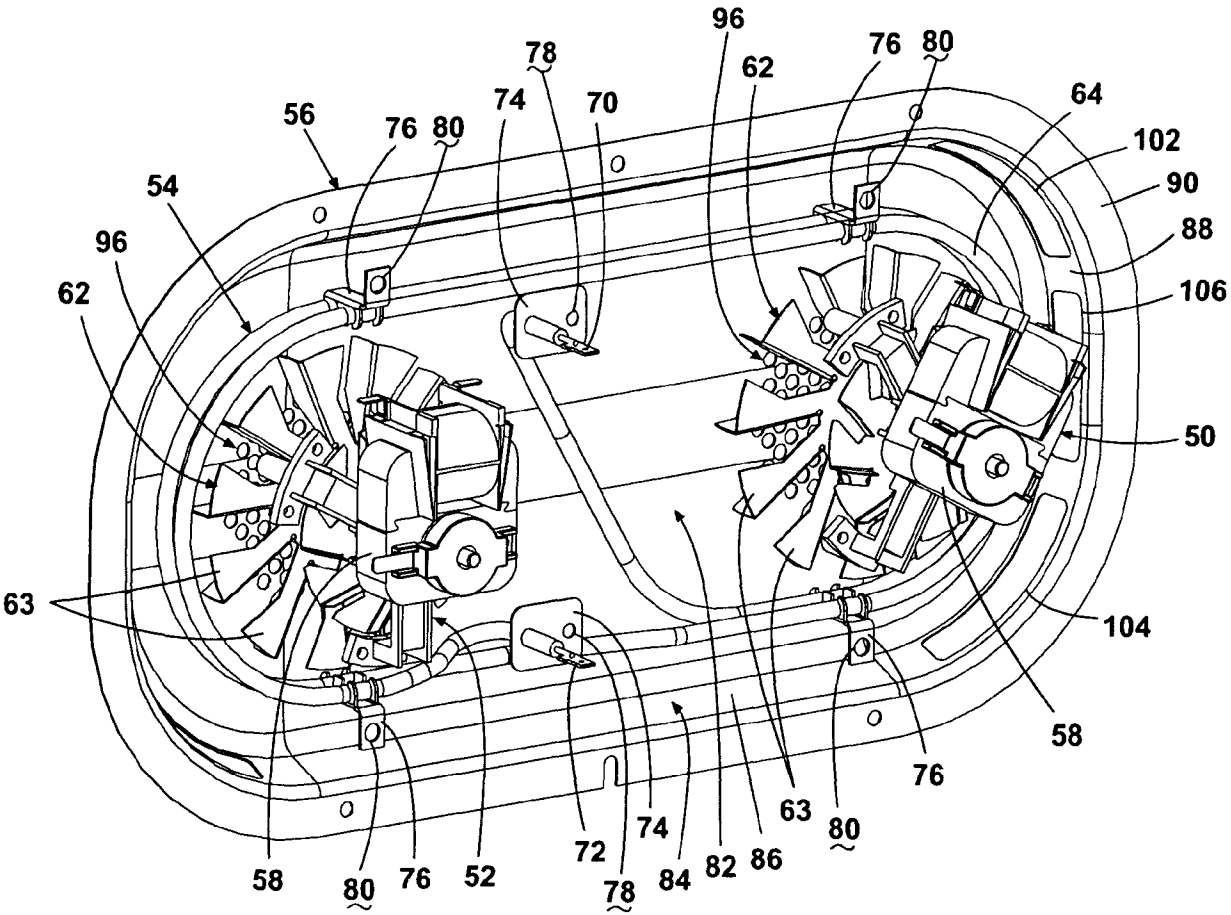
FIG. 3 is a rear perspective view of the convection system according to the present invention, comprising two fan assemblies, a heating element, and a baffle.
Figure 4:
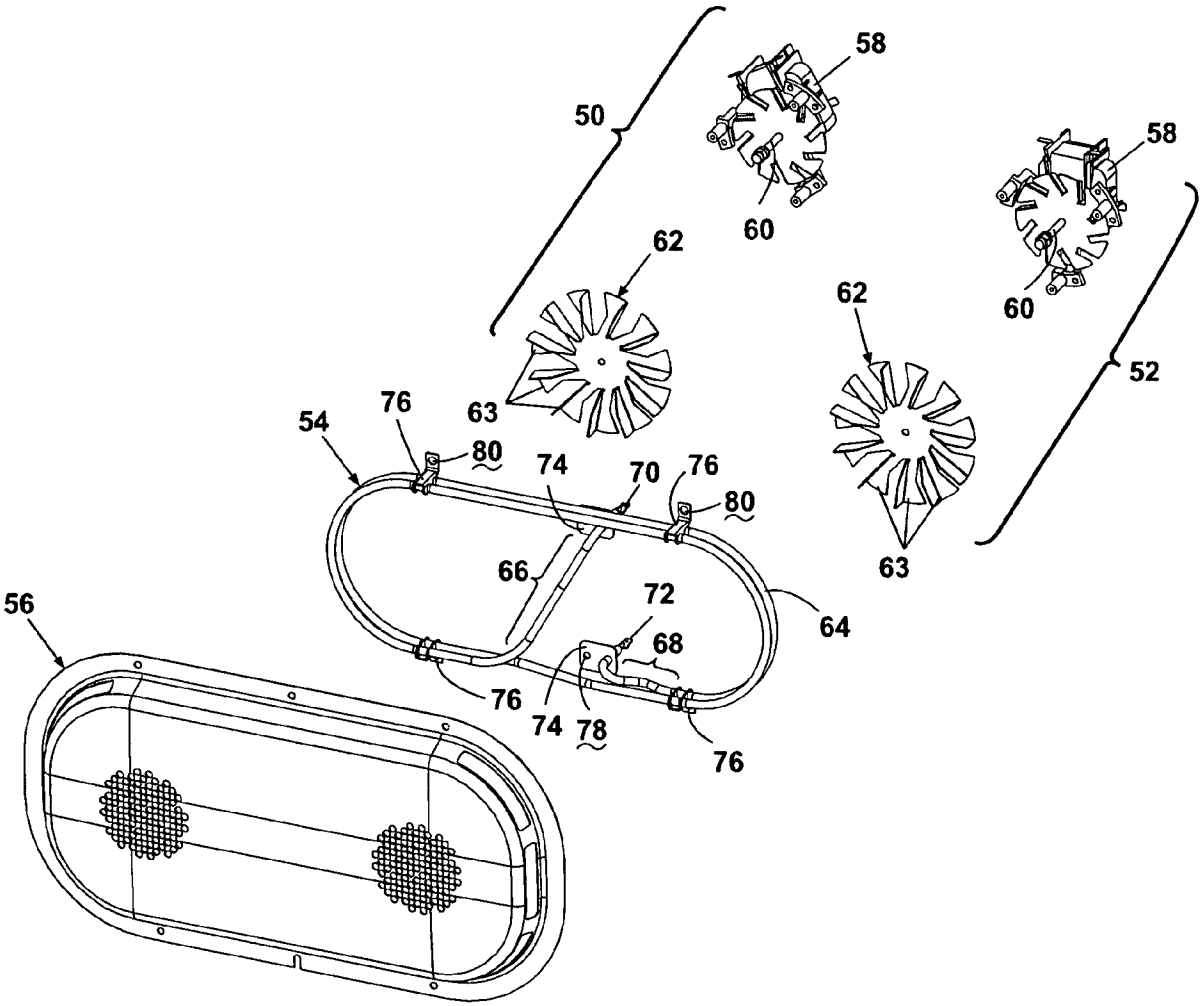
FIG. 4 is an exploded view of the convection system according to the present invention.

Referring to FIGS. 3-4, the convection system 12 comprises two fan assemblies 50, 52 a heating element 54, and a baffle 56. The fan assemblies 50, 52 are substantially identical, and each comprises a motor 58 having a drive shaft 60, with an impeller or fan 62 coupled to the drive shaft 60 for rotation therewith. Each fan 62 includes a plurality of blades 64 that are preferably curved or angled. The fan assemblies 50, 52 are spaced from each other horizontally, and are mounted at the center of the rear wall 16 of the oven cavity 22.

The heating element 54 comprises a conventional electrical resistance element that surrounds both fan assemblies 50, 52. The heating element 48 is illustrated as a single electrical heating element formed into a double pass coil disposed around the fan assemblies 50, 52. The double pass coil includes a heated length 64 formed into two loops, with first and second cold sections 66, 68 at either end of the heated length. The cold sections 66, 68 each have a respective electrical terminals 70, 72 for connection of the heating element 54 to a source of power (not shown).

The heating element 54 further includes one or more mounting brackets 74 for mounting the heating element 54 to the rear wall 16 of the oven cavity 22 and one or more mounting spacers 76 for maintaining the loops of the heated length 64 in spaced relation. The mounting brackets 74 and the mounting spacers 76 include a screw hole 78, 80, respectively, for receiving screws (not shown) to fix the mounting brackets 74 and the mounting spacers 76 to the rear wall 16 of the oven cavity 22. Each cold section 66, 68 passes through one of the mounting brackets 74.

Figure 5:
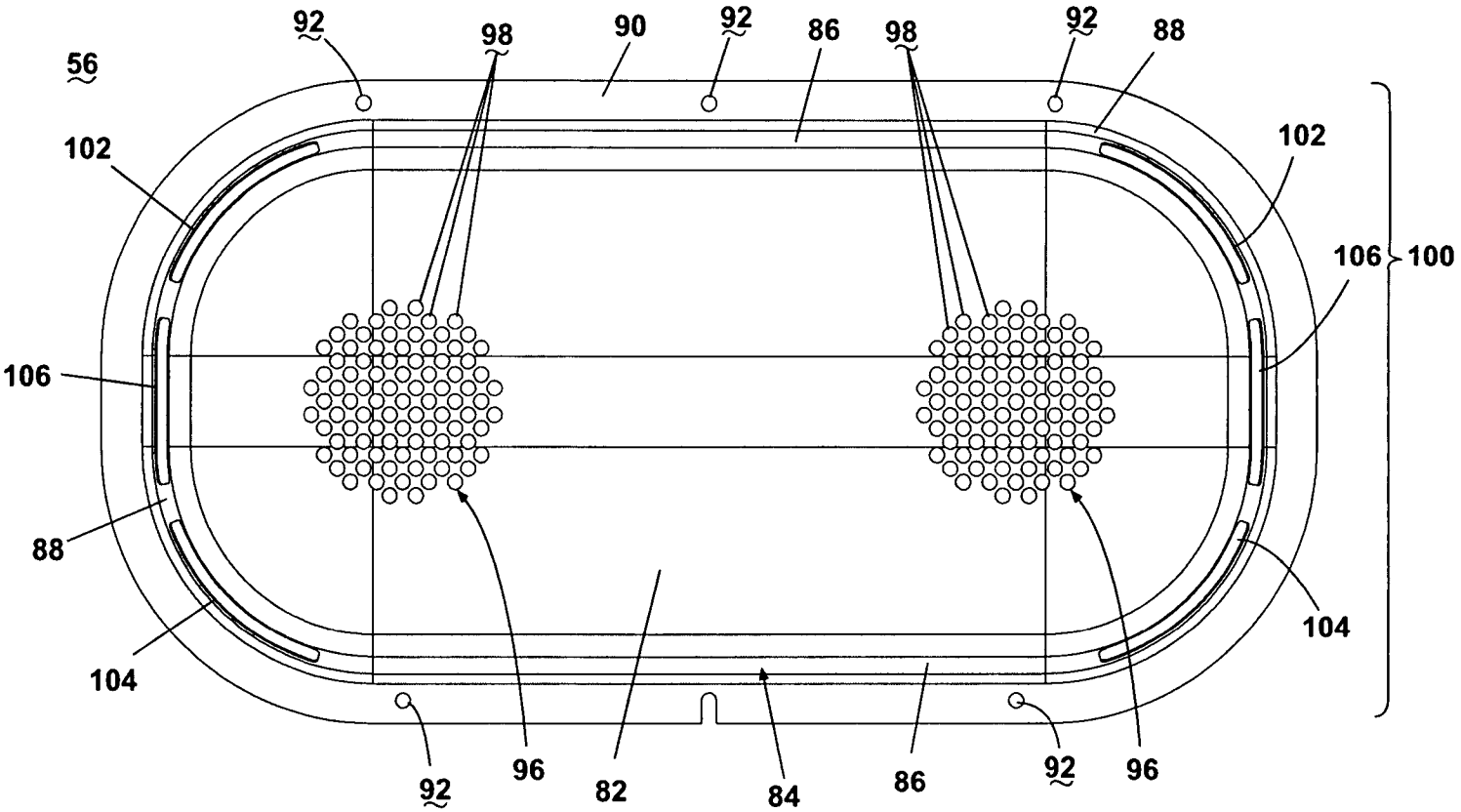
FIG. 5 is a front view of the baffle from FIG. 3.

Referring to FIG. 5, the baffle 56 comprises a front wall 82 and a peripheral wall 84 extending around the perimeter of the front wall 82. The peripheral wall 84 includes two generally straight upper and lower sides 86 spaced from each other and joined by arcuate lateral sides 88. A flange 90 is joined with and extends outwardly from the peripheral wall 84. The flange 90 is used to mount the baffle 56 to the rear wall 16 and can comprise one or more screw holes 92 for receiving screws (not shown) to fix the baffle 56 to the rear wall 16 of the oven cavity.

At least one air inlet 96 is formed on the baffle 56 for allowing air from the oven cavity 22 to enter the convection system 12. As illustrated herein the baffle 56 comprises two air inlets 96 that are generally aligned with the fan assemblies 50, 52 when the convection system 12 is assembled. Each air inlet 96 comprises a plurality of apertures 98 formed in the front wall 82.

An air outlet 100 is also formed on the baffle 56 for allowing air from the convection system 12 to enter the oven cavity 22. As illustrated herein, the air outlet 100 comprises three slots 102, 104, 106 formed in each arcuate lateral side 88 of the peripheral wall 84, so that the slots 102, 104 are radially disposed with respect to the fan assemblies 50, 52, when the convection system 12 is assembled. The top slot 102 extends from the top of the arcuate lateral side 88, the bottom slot 104 extends from the bottom of the arcuate lateral side 88, and the side slot 106 is intermediate the top and bottom slots 102, 104. The side slot 106 is further horizontally disposed relative to the adjacent air inlet 96, and is thus laterally disposed relative to the adjacent fan assembly 50, 52.

Figure 6:
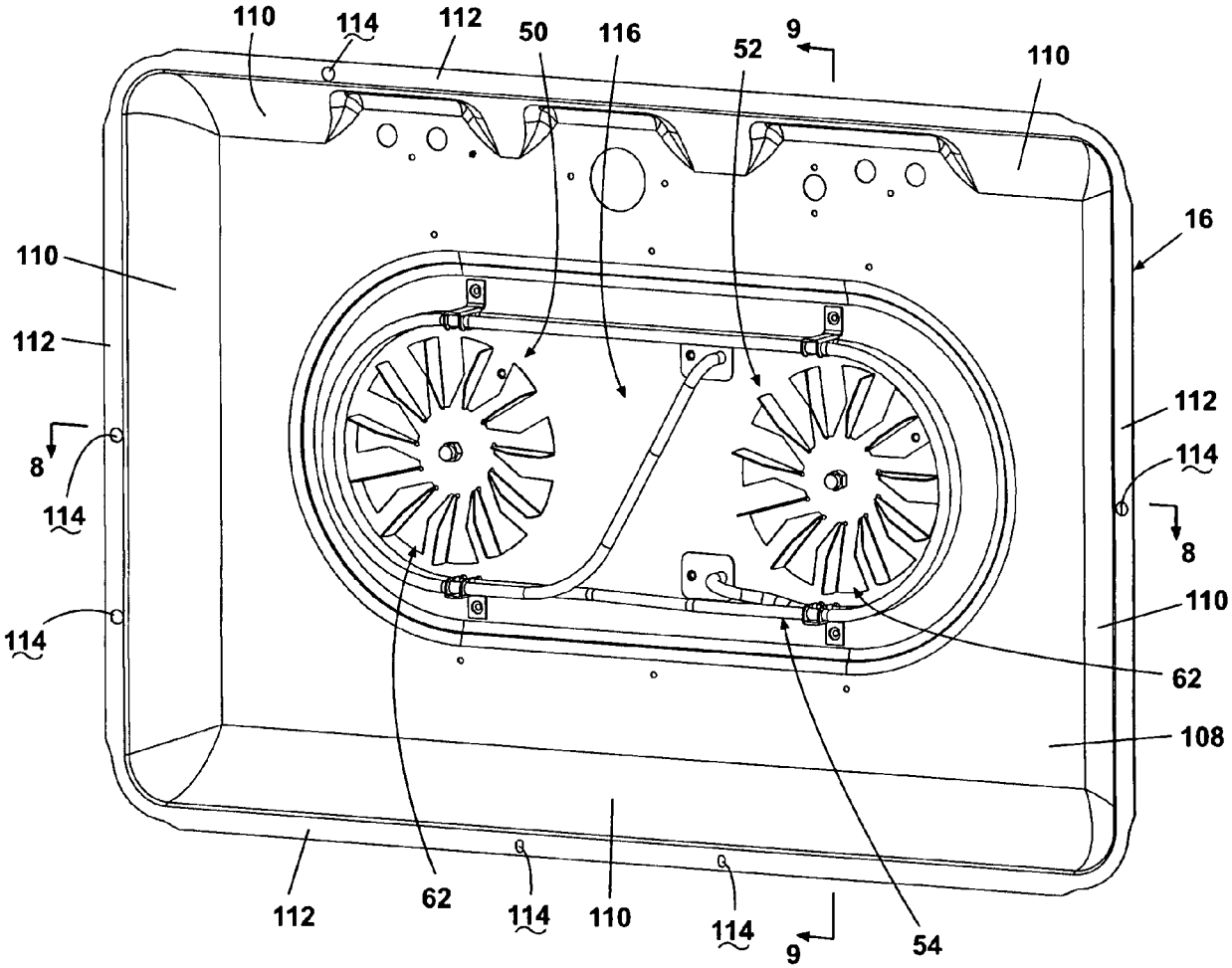
FIG. 6 is a perspective view of the convection system according to the present invention mounted on an exemplary oven rear wall.
Figure 7:
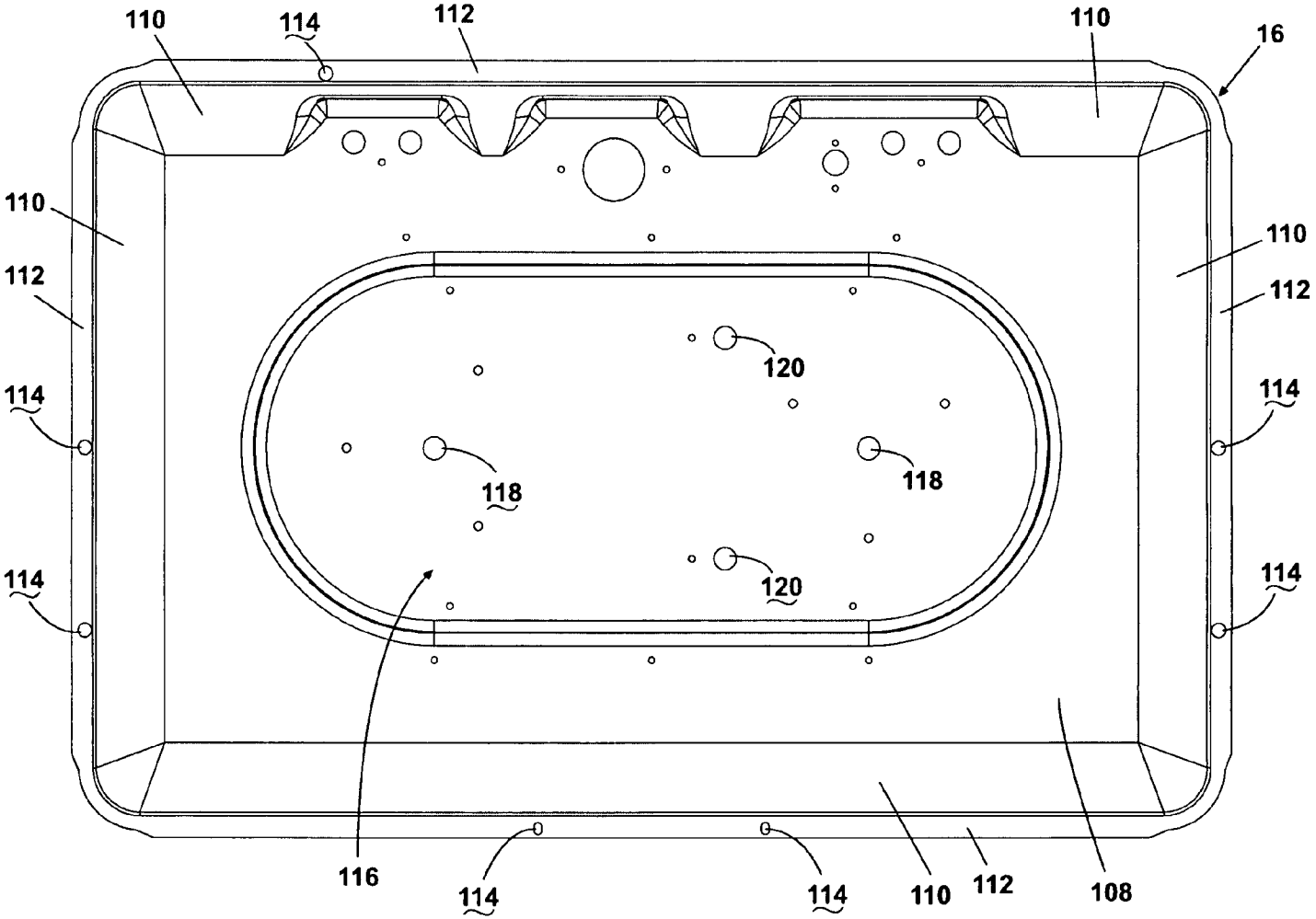
FIG. 7 is a front view of the oven rear wall from FIG. 6.

An exemplary oven cavity rear wall 16 on which the convection system 12 can be mounted is shown in FIG. 6, with the baffle removed for clarity. A front view of the exemplary oven cavity rear wall 16 is shown in FIG. 7. The rear wall 16 comprises a generally flat panel 108 having a curved peripheral edge 110 extending along at least a portion of the periphery of the flat panel 108. As illustrated, the curved peripheral edge 110 extends substantially about the entire periphery of the flat panel 108. A flange 112 is joined with and extends outwardly from the curved peripheral edge 110. The flange 112 is used to mount the rear wall 16 to the rest of the oven housing 14 and can comprise one or more screw holes 114 for receiving screws (not shown) to fix the rear wall to the rest of the oven housing 14.

A depression 116 is formed in the center of the flat panel 108 and two spaced, horizontally aligned holes 118 are formed within the depression 116 for receiving the drive shafts 60 of the motors 58. The fan assemblies 50, 52 are mounted to the rear wall 16 with each drive shaft 60 extending through one of the holes 118 such that the fans 62 are on the side of the rear wall 16 facing the heating chamber 94 and the motors 58 are on the opposite side of the rear wall 16. A pair of vertically aligned holes 120 are also formed within the depression 116 by which the cold sections 66, 68 of the heating element 54 pass through the rear wall 16.

Figure 8:
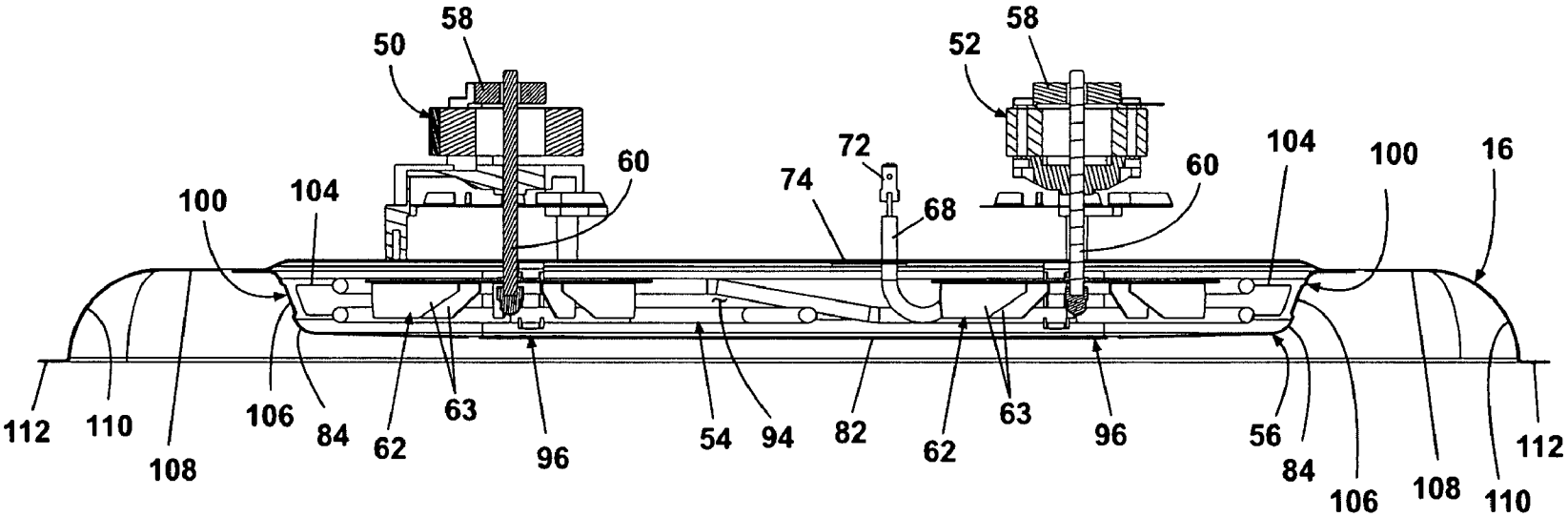
FIG. 8 is a cross-sectional view through line 8-8 of FIG. 6.
Figure 9:
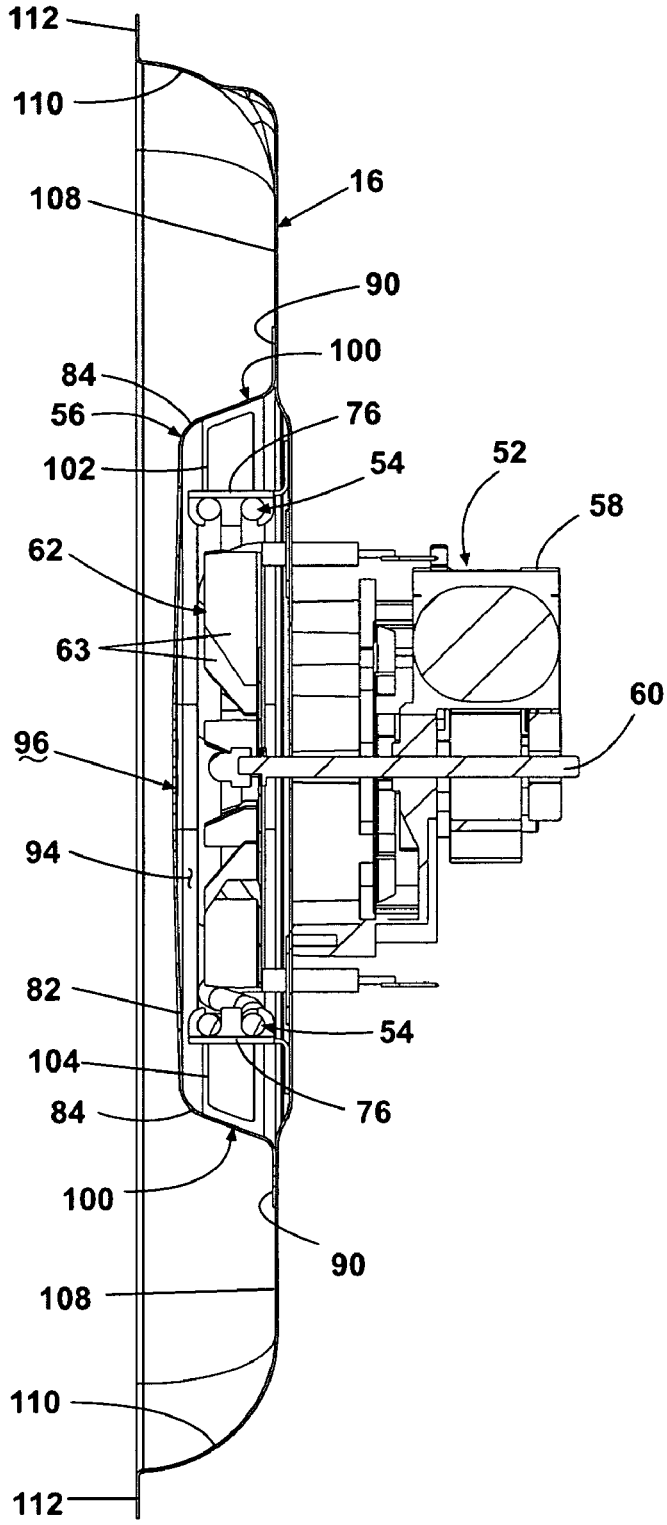
FIG. 9 is a cross-sectional view through line 9-9 of FIG. 6.

Referring to FIGS. 8-9, when mounted to the rear wall 16, the baffle 56 defines a single heating chamber 94 between the front wall 82, the peripheral wall 84 and the rear wall 16. In this position, the baffle 56 surrounds the fan assemblies 50, 52 and the heating element 54, essentially containing the fan assemblies 50, 52 and the heating element 54 within the heating chamber 94. The baffle 56 is generally aligned with the depression 116 when it is fixed to the rear wall 16 to cover the fans assemblies 50, 52 and the heating element 54. Furthermore, when the baffle 56 is mounted to the rear wall 16, the air outlets 100 of the baffle 56 are positioned to face at least a portion of the curved peripheral edge 110.

In operation, during a convection cycle of the oven 10, the fan assemblies 50, 52 intake air from the oven cavity 22 through the air inlets 96 and into the heating chamber 94. The fan assemblies 50, 52 then force the air over the heating element 54, which transfers heat to the air, to produce a heated airflow. The heated airflow exits the heating chamber 94 through the air outlets 100 and reenters the oven cavity 22. During the convection cycle, both fans 62 will preferably rotate continuously in the same direction, pulling air into the air inlets 96 and radially exhausting air heated by the heating element 54 through the air outlets 100.

Figure 10:
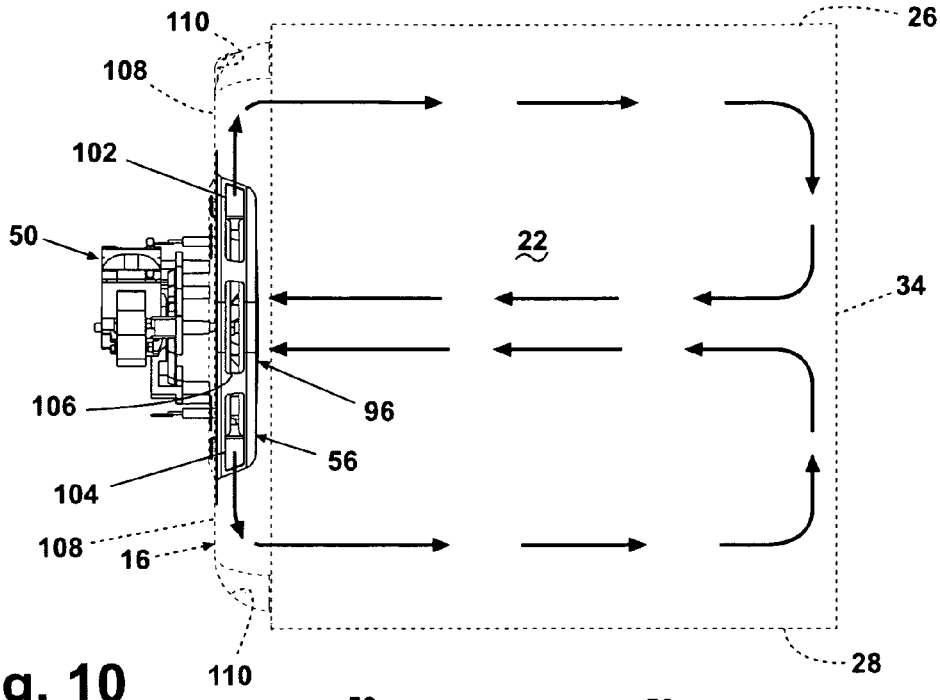
FIG. 10 is a side schematic view of an exemplary oven comprising the exemplary oven rear wall from FIG. 6 and the convection system according to the invention, illustrating the circulation of air within the exemplary oven.
Figure 11:
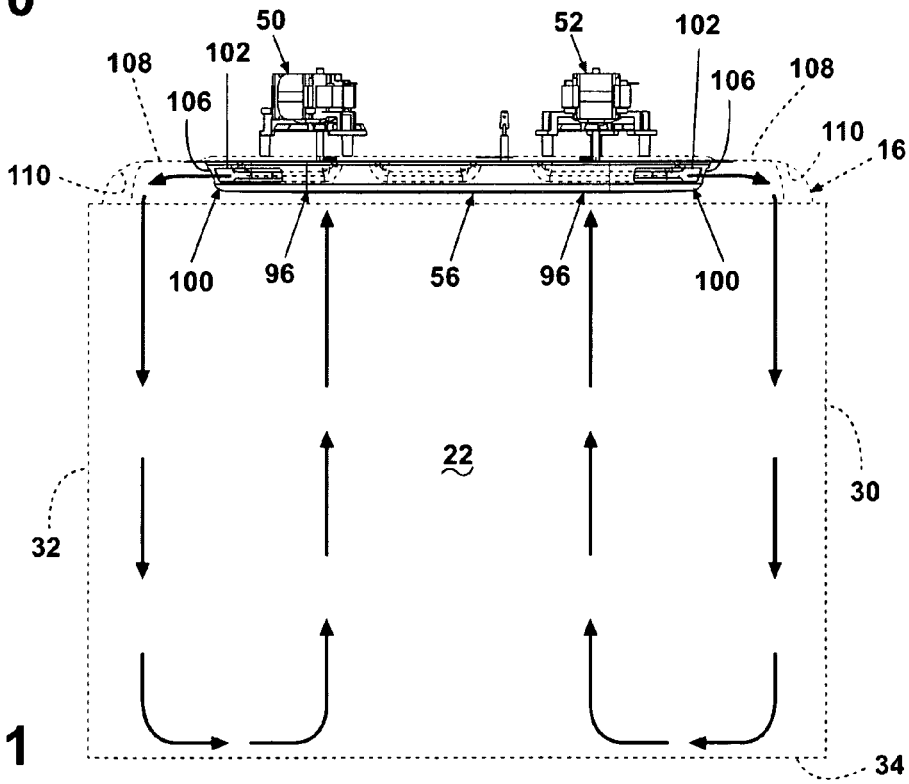
FIG. 11 is a top schematic view of an exemplary oven comprising the exemplary oven rear wall from FIG. 6 and the convection system according to the invention, illustrating the circulation of air within the exemplary oven.

Referring to FIGS. 10-11, the convection oven 10 is shown comprising the exemplary rear wall 16 and the convection system 12 to illustrate the circulation pattern of the air. As the heated airflow is exhausted through the air outlets 100, it is directed radially outwardly from the fans 62 through the slots 102, 104, 106, and along the flat panel 108 of the rear wall 16 to the curved peripheral edge 110, which directs or deflects the heated airflow away from the rear wall 16 and towards the door 32 closing the open front face 24 of the oven cavity 22. Since the slots 102, 104, 106 are radially oriented relative to the fans 62, the circulation pattern, indicated by the arrows, of the heated airflow will have significant vertical and horizontal components. Additionally, because both fans 62 preferably rotate continuously in the same direction, the heated airflow will also have a significant toroidal component.

The convection system 12 described herein will enhance convection-cooking performance by using multiple fans and a single element as a heat convection source within a single heating chamber, creating a uniform air flow inside the oven cavity which will yield a smaller temperature gradient within the oven cavity. Having a common chamber for the fans enables cross-flow between the fans, which helps balance the airflow in the chamber. A smaller temperature gradient results in a more uniform heating within the oven cavity, and a more uniform baking performance.

While the invention has been specifically described in connection with certain specific embodiments thereof, it is to be understood that this is by way of illustration and not of limitation, and the scope of the appended claims should be construed as broadly as the prior art will permit.

What is claimed is:

1. A convection oven comprising:

a housing defining an oven cavity; and a convection system fluidly coupled to the oven cavity, comprising:

a baffle mounted to the housing and defining a single heating chamber, and having an inlet and an outlet fluidly coupling the single heating chamber with the oven cavity;

a heating element located within the single heating chamber for heating air within the heating chamber; and at least two fans located within the heating chamber for drawing air from the oven cavity into the heating chamber through the inlet, and exhausting air heated by the heating element from the heating chamber to the oven cavity through the outlet.

2. The convection oven from claim 1, wherein the heating element is a single heating element shared by the at least two fans.

3. The convection oven from claim 2, wherein the heating element is disposed around the fans.

4. The convection oven from claim 1, wherein the at least two fans are in direct fluid communication with each other.

5. The convection oven from claim 1, wherein the baffle comprises a front wall and a peripheral wall.

6. The convection oven from claim 5, wherein the inlet comprises at least two inlet apertures formed in the front wall of the baffle, with at least one of the two inlet apertures located over at least one of the fans.

7. The convection oven from claim 5, wherein the outlet comprises at least two outlet apertures formed in the peripheral wall of the baffle, and positioned laterally with respect to the fans.

8. The convection oven from claim 7, wherein the peripheral wall of the baffle comprises curved lateral sides, and the outlet apertures are formed in the curved lateral sides.

9. The convection oven from claim 1, wherein the convection system further comprises at least two motors mounted exteriorly of the oven cavity, each having a drive shaft that is coupled to one of the at least two fans.

10. The convection oven from claim 1, wherein the housing comprises a rear wall, and the baffle is mounted to the rear wall.

11. The convection oven from claim 10, wherein the rear wall comprises at least a portion having a curved peripheral edge.

12. The convection oven from claim 11, wherein the outlet faces at least a portion of the curved peripheral edge.

13. The convection oven from claim 10, wherein the heating element is mounted to the rear wall.

14. The convection oven from claim 1, wherein the at least two fans are oriented to rotate in the same direction.

15. A convection oven comprising:

a housing having a rear wall with a curved peripheral edge and a peripheral wall extending from the curved peripheral edge to define an oven cavity with an open face;

a door moveably mounted to the housing for selectively closing the open face; and a convection system having an inlet and an outlet in fluid communication with the oven cavity, with the outlet facing at least a portion of the curved peripheral edge and adjacent the rear wall wherein air exiting the outlet is directed along the rear wall to the curved peripheral edge, which deflects the air toward the open face.

16. The convection oven from claim 15, wherein the convection system further comprises a baffle having a peripheral wall, and the outlet is formed in at least a portion of the peripheral wall of the baffle.

17. The convection oven from claim 16, wherein the outlet comprises a plurality of apertures in the peripheral wall of the baffle.

18. The convection oven from claim 17, wherein the apertures extend from a lateral side to at least one of an upper and lower side of the peripheral wall of the baffle.

19. The convection oven from claim 16, wherein the baffle further comprises a front wall joined with the peripheral wall, and the inlet is formed in at least a portion of the front wall of the baffle.

20. The convection oven from claim 19, wherein the front wall of the baffle is substantially orthogonal to the peripheral wall of the baffle.

21. The convection oven from claim 19, wherein the inlet comprises at least two inlet apertures formed in the front wall of the baffle.

22. The convection oven from claim 21, wherein at least one of the inlet apertures is located over a fan positioned between the baffle and the rear wall.

23. The convection oven from claim 15, wherein the convection system further comprises at least two fans for drawing air from the oven cavity into the convection system through the inlet, and exhausting air from the convection system to the oven cavity through the outlet.

24. The convection oven from claim 23, wherein the at least two fans are oriented to rotate in the same direction.

* * * * *